United States Patent [19]

Jackson

[11] 4,168,225

[45] Sep. 18, 1979

[54] METHOD FOR REMOVING SULFUR IMPURITIES FROM PETROLEUM LIQUIDS

[76] Inventor: Herman R. Jackson, 1981 San Marco Blvd., Jacksonville, Fla. 32207

[21] Appl. No.: 863,541

[22] Filed: Dec. 22, 1977

Related U.S. Application Data

[62] Division of Ser. No. 657,332, Feb. 11, 1976, Pat. No. 4,077,878.

[51] Int. Cl.[2] ..... C10G 17/02

[52] U.S. Cl. ..... 208/219; 208/238; 208/243; 210/50; 210/63 R

[58] Field of Search ..... 106/197 C; 208/208 R, 208/216, 237–240, 243, 250, 219; 210/29, 36, 39, 40, 50, 59, 63 R, 75, 243, 504, 506, 507; 252/104, 163, 172, 468

[56] References Cited

U.S. PATENT DOCUMENTS

| | | | |
|---|---|---|---|
| 2,725,301 | 11/1955 | Mayer et al. | 106/197 C |
| 3,360,330 | 12/1967 | Hoekstra | 252/468 |
| 3,766,075 | 10/1973 | Jackson | 252/163 |
| 3,905,910 | 9/1975 | Coombs et al. | 210/75 |

*Primary Examiner*—Charles N. Hart
*Assistant Examiner*—Peter A. Hruskoci
*Attorney, Agent, or Firm*—Sughrue, Rothwell, Mion, Zinn and Macpeak

[57] ABSTRACT

A method for removing sulfur impurities from petroleum liquids comprising adding to the petroleum liquid a fatty acid, naphthalene, water and a cellulosic container containing a cellulosic material coated with a chromate compound.

7 Claims, No Drawings

METHOD FOR REMOVING SULFUR IMPURITIES FROM PETROLEUM LIQUIDS

This is a division of application Ser. No. 657,332, filed Feb. 11, 1976 now U.S. Pat. No. 4,077,878.

BACKGROUND OF THE INVENTION

1. Field of the Invention

The present invention concerns removing sulfur impurities from petroleum products such as crude oil, gasolines, etc.

2. Description of the Prior Art

In my prior U.S. Pat. No. 3,766,075, an invention was disclosed wherein residual moisture and impurities contained in typical formulations of drycleaning solvents and petroleum products could be removed (without creating the adverse effects known to the prior art) by adding an unsubstituted aromatic hydrocarbon or a halogen or alkyl-substituted aromatic hydrocarbon together with a dried cellulosic material onto which has been precipitated a fine deposit of an oxidizing agent such as lead dichromate to an organic dry cleaning solvent. The treated cellulosic material was disclosed as absorbing excess moisture present in the solvent mixture as well as removing impurities therefrom through oxidation by means of the employed dichromate.

The present invention is an improvement on the preceeding method.

SUMMARY OF THE INVENTION

The present invention provides a method for removing impurities from petroleum liquids comprising adding to said liquids an unsubstituted or halogen or alkyl-substituted aromatic hydrocarbon together with a dried cellulosic material onto which has been coated a mixture of (1) chromates, including dichromates, such as lead chromate or lead dichromate, which can form into a solid when dried, and (2) a sealing compound such as a polymeric material or a cellulosic gum, the dried cellulosic material being itself contained in a cellulosic container, such as a cellulosic bag, which is electrically grounded to a tank, such as a fuel tank or to a D.C. power supply.

DESCRIPTION OF THE PREFERRED EMBODIMENTS

The present invention contemplates adding to petroleum products an unsubstituted aromatic hydrocarbon or a halogen or alkyl substituted aromatic hydrocarbon having a boiling point between about 78° and 250° C. Typical examples of suitable unsubstituted aromatic hydrocarbons are benzene and naphthalene. Suitable alkyl-substituted aromatic hydrocarbons are lower alkyl, preferably methyl- or ethyl-, substituted aromatic hydrocarbons, such as xylene, toluene, and the like. Further, suitable halogen-substituted aromatic hydrocarbons are chlorobenzene and the like. However, the present invention is expressly applicable to those compounds satisfying the above property, although not specifically enumerated in the present specification. Those of ordinary skill in the art, with a minimum degree of experimentation, are certainly able to practice the present invention using aromatic compounds having the necessary boiling point but not specifically identified herein, according to the end use desired.

As indicated above, the present invention also contemplates the addition of a cellulosic bag device to liquid petroleum product which comprises a cellulose material which can be folded upon itself so as to be closed and thereby form a "bag" and which contains another cellulosic material which has had coated thereon a dried mixture of chromate and a sealing agent such as a cellulosic gum, for example, carboxymethyl cellulose, or a suitable polymeric material such as polypropylene, nylon or cellulose acetate (as long as it acts to seal the dried chromate compound onto the cellulosic material). Any chromate or dichromate compound can be employed as long as a solid is formed when the chromate is dried. Chromate compounds other than lead chromate or lead dichromate, such as barium chromate, may actually be preferred for environmental reasons. Typical cellulose materials include, for example, cotton rags, cotton cloth or plain cloth, cotton towelling, or any other material containing cellulose fibers. Generally, any amount of the dried cellulosic material (i.e., the cellulosic material inside the cellulosic "bag") can be added to the liquid petroleum per 100 gallons of the organic solvent as the amounts are not critical. The larger the amount (surface area) of the dried cellulosic material used, the greater the contact of the petroleum liquid with the chromates, and thus the better the results.

The chromate or dichromate compound can be coated onto the cellulosic material by painting with an aqueous mixture of chromate and sealing compound or by dipping the cellulosic material into a tank containing the aqueous mixture of chromate-sealing compound.

According to one preferred embodiment, the cellulosic bag device is produced in the following manner:

First, a mixture is prepared which contains chromate (such as, for example, lead chromate), carboxymethyl cellulose and water, the amounts of the ingredients and the proportions thereof being variable, the only requirement being that sufficient amounts of (lead) chromate and carboxymethyl cellulose are used to provide sufficient dry cleaning action with the ultimately produced "bag" product.

Second, the aqueous solution of (lead) chromate and carboxymethyl cellulose is then coated onto one or both sides of a cellulose material, in any number of coating applications such that the desired amount of mixture is coated on and impregnated into the cellulose material. The cellulose material can preferably comprise a cotton towel, and can generally be on the order of 2'×3' in dimensions, although other sizes, either larger or smaller can operate successfully.

Next, the coated cellulose material is allowed to dry.

After the coated cellulose material is dried, additional coatings of carboxymethyl cellulose in aqueous solution can be applied thereto, the coating solutions either containing or optionally not containing (lead) chromate.

The thus-coated cellulose material is then dried as before. By following the foregoing procedure, a 2'×3' cotton towel can be made to hold typically 300–400 grams of (lead) chromate or more. The greater the total amount of (lead) chromate coated onto the cellulose material, the longer the useful life of the treated cellulose material when used according to the invention.

Finally, in order to produce the bag product of the present invention, the obtained coated cellulose material is then placed within a cellulose container, preferably a cotton bag, and the bag is then closed (e.g., sewn). Optionally, more than one cellulose container can be used in accordance with the present invention, i.e., one cellulose container, after closing, can then be placed in another cellulose container, which itself is then closed, etc.

After the bag device has been fabricated, it can then be placed in a tank containing the petroleum product but only after it has been electrically connected to a ground and has been weighted down by a sufficiently heavy weight (in order to keep the bag device submerged). The "ground" can be produced by wrapping a copper wire around the bag device at different corners thereof with sufficient dangling wire left over to contact the walls of the tank. Alternatively, and for better results, the copper wire is connected to the negative terminal of a low voltage D.C. power supply (the positive terminal of which is connected to a ground), the copper wire being insulated from electrical contact with any intermediate "grounds." In this way the cellulosic bag device is placed in the liquid petroleum product. More than one cellulosic bag device can be added to obtain even better results, although as long as the liquid petroleum product goes through the bag, then only one bag device is actually needed for the present invention to operate successfully.

A typical chromate mixture can be formed by mixing 2 parts of barium chloride with 3 parts of sodium dichromate with water, water washing the solid precipitate formed several times, and recovering the dried product. Alternatively, 1 part of chromic acid can be mixed with 2 parts of barium chloride, etc.

The chromates can then be placed on the cellulosic material, if desired, and sealed with an aqueous solution of carboxymethyl cellulose. Alternatively (as noted above), the chromates can be mixed with an aqueous solution of carboxymethyl cellulose first, and then applied to the cellulosic material. The carboxymethyl cellulose acts to seal the chromates on the cellulosic material so that even during prolonged use the chromates will not wash away. In this regard, in my previous U.S. Pat. No. 3,766,075 the chromates used would eventually wash off the dried cellulosic material (cotton rags) and the advantageous results of the invention would be seriously reduced, or ultimately lost.

Also, the cellulosic bag container allows for constant electrical contact with the base tank or with the negative terminal of a D.C. power supply (due to the wires attached thereto), which is a distince improvement over U.S. Pat. No. 3,766,075 wherein the cotton rags would be grounded only as they haphazardly touched the sides of the base tank washer. The cellulosic gum (polymeric material or carboxymethyl cellulose) seals the chromates onto the cellulosic material and thereby reduces the hazard of lead pollution of the petroleum liquids (i.e., if lead chromate is used, less of it is lost from the cellulosic material onto the liquid than in U.S. Pat. No. 3,766,075) and extends the life of the cellulosic material.

I have discovered that sulfur impurities may be removed from petroleum products such as crude oil, gasoline, jet fuel, diesel oil, and like petroleum products, in an improved fashion by adding thereto the cellulosic container device as previously described, in conjunction with a small amount of naphthalene. The naphthalene is added to the petroleum products in an amount of from about 2 liquid ounces or more per 100 gallons of the petroleum liquid, depending upon the amount of impurities present. The cellulosic container device, which has the copper wires attached thereto, is electrically grounded to the vessel in which the petroleum products are contained (or connected to a D.C. power supply) in the same fashion as described previously with respect to the petroleum liquids purification embodiment of this invention.

Further, as noted in my previous U.S. Pat. No. 3,766,075, it has been found that a small amount of water should be present in the petroleum products containing the cellulosic container device and the naphthalene. Generally, from about 1 pint to about 1 gallon of water should be present per 100 gallons of the petroleum products. If this amount of moisture is not present in the petroleum products, it should be added thereto to allow for the necessary oxidation and reduction process to occur. The temperature at which the petroleum liquid should be maintained during removal of impurities therefrom by the use of such a composition is about 20° F. below the boiling point of the treated material. Of course, this temperature may vary as desired, with the proviso that the use of a low temperature results in the removal of the impurities taking a longer time. Generally, by operating within the parameters above indicated, the removal of sulfur compounds from petroleum products, such as gasoline, is very effective by the use of such a composition.

Although the reason why these materials will remove sulfur impurities from petroleum products is not specifically known, it is believed that the naphthalene undergoes an endothermic reaction which causes the atoms in the naphthalene molecule to come closer together, thus giving off a small amount of electric current which is attracted by the cellulosic material (which has the capability of transmitting an electric current). The chromate molecules contained on the cellulosic material probably oxidize the sulfur compounds which are contained in the petroleum products to sulfate, sulfite, etc., which can be removed by any suitable means such as filtration through a filter, using as a filter aid cellulose pulp. It is important to remove sulfur from petroleum products such as gasoline, since sulfur compounds present therein adversely effect any lead additive which may be present in the gasoline. The addition of the above materials to petroleum products, such as gasoline, would diminish or substantially eliminate this effect and increase the efficiency of the lead additive contained in the gasoline (i.e., increase the mileage driven per unit volume of gasoline).

Obviously, as a result of the generation of the electric current, the vessel in which the liquid is contained should be grounded or else connected to the negative terminal of a D.C. power supply.

In another embodiment of the present invention, the cellulosic container device can be placed in a petroleum fuel tank (or fuel line) containing crude oil, or hydrocarbon fuels obtained from shale or coal, together with napthalene and 2 to 5 ounces of a soluble organic acid per 100 gallons of petroleum liquid, preferably a short-chain, high acid number, low iodine-containing fatty acid such as sebacic acid, (although longer-chain acids can also be used, e.g., oleic acids, stearic acids, etc.) in order to enhance the combustion characteristics of the fuel and add to its burning time by sulfur removal therefrom. In this embodiment, the cellulosic material with the cellulosic bag container is impregnated with barium chromate and sealed therein with carboxymethyl cellulose (or other polymer substances) and the cellulosic bag device made in the same way as discussed previously. The naphthalene is added to the fuel in a range of 2 to 5 ounces of naphthalene per 100 gallons of fuel, and the organic acid is added in a similar range. Water in a small amount should be added as in the previous embodiment. More of each of these additives depending on their solubility in the fluid (up to their saturation point) can be employed if desired. It is believed that the naphthalene undergoes an endothermic reaction which causes the atoms in the naphthalene molecule to come closer together, thus giving off a small amount of electric current (from the hydrogen atoms). The cellulosic material (cotton towel) carries the current and the atoms in the barium chromate become ions. The organic acids in the fuel oxidize and become carbon dioxide and water and provide the H+ ions to facilitate the oxidation process. This oxidation facilitates the ultimate combustion properties of the fuel. It should be noted that this embodiment can also be used to purify and improve the dry cleaning properties of dry cleaning fluids.

It should furthermore be specifically noted that with respect to this latter embodiment of the invention, the cellulose "bag" previously described in actuality need not be employed to contain the coated and impregnated cellulose material, i.e., provided that the cellulose material has attached thereto a copper wire or wires of sufficient length that a constant grounding with the encompassing vessel (or to a D.C. power supply) for the petroleum liquid (or dry cleaning fluid) is maintained.

If, in the previous embodiment of my invention, the cellulosic material impregnated with the chromate compound is in fact connected to the negative terminal of a D.C. power supply, the requirement to add naphthalene to the petroleum liquids is eliminated.

The above description should not be taken as limiting the present invention to the actual embodiments specifically disclosed, but should be deemed to describe equivalents thereof which may be employed in the practice of the present invention. Those of ordinary skill in the art may make suitable modifications of the present invention according to the above description, without departing from the scope thereof.

I claim:

1. A method for removing sulfur impurities from petroleum liquids which comprises: adding to said petroleum liquid 2 to 5 ounces of a fatty acid per 100 gallons of petroleum liquid, 2 to 5 ounces of naphthalene per 100 gallons of petroleum liquid, water to make about 1 pint to about 1 gallon of water per 100 gallons of petroleum liquid, and a cellulosic container (a) which has at least one grounded copper wire attached to one end of said container and (b) which encloses a cellulosic material which has been coated with a chromate compound, said chromate compound being sealed on said cellulosic material with a sealing compound.

2. The method of claim 1, wherein said chromate is barium chromate.

3. The method of claim 2, wherein said sealing compound is carboxymethyl cellulose.

4. A method of removing sulfur impurities from petroleum liquids which comprises: adding to said petroleum liquids about 2 to about 5 ounces of a fatty acid per 100 gallons of petroleum liquid, water to make about 1 pint to about 1 gallon of water per 100 gallons of petroleum liquid, and a cellulosic container (a) which has at least one copper wire attached to one end of said container with the other end of said at least one copper wire being attached to the negative terminal of a D.C. power supply, and (b) which encloses a cellulosic material which has been coated with a chromate compound, said chromate compound being sealed on said cellulosic material with a sealing compound.

5. The method of claim 4 wherein said chromate is barium chromate.

6. The method of claim 5, wherein said sealing compound is carboxymethyl cellulose.

7. The method of claim 4, wherein after adding said fatty acid and said cellulosic material to said petroleum liquids said petroleum liquids are passed through a filter which employs cellulosic material as a filter aid.

* * * * *